US006899216B2

(12) United States Patent
Levy

(10) Patent No.: US 6,899,216 B2
(45) Date of Patent: May 31, 2005

(54) ESCALATOR FOR NEGOTIATING CURVES

(75) Inventor: John Court Levy, London (GB)

(73) Assignee: Levytator Limited (GB)

( * ) Notice: Subject to any disclaimer, the term of this patent is extended or adjusted under 35 U.S.C. 154(b) by 51 days.

(21) Appl. No.: 10/433,285

(22) PCT Filed: Dec. 5, 2001

(86) PCT No.: PCT/GB01/05386

§ 371 (c)(1),
(2), (4) Date: Jun. 2, 2003

(87) PCT Pub. No.: WO02/46087

PCT Pub. Date: Jun. 13, 2002

(65) Prior Publication Data

US 2004/0050654 A1 Mar. 18, 2004

(30) Foreign Application Priority Data

Dec. 5, 2000 (GB) ..... 0029624

(51) Int. Cl.[7] ..... B66B 21/02
(52) U.S. Cl. ..... 198/328; 198/333
(58) Field of Search ..... 198/328, 326, 198/327, 333

(56) References Cited

U.S. PATENT DOCUMENTS

| | | | | |
|---|---|---|---|---|
| 2,823,785 A | * | 2/1958 | Hefti | 198/328 |
| 3,395,648 A | * | 8/1968 | Karr et al. | 198/321 |
| 3,515,253 A | * | 6/1970 | Yamada | 198/328 |
| 3,878,931 A | | 4/1975 | Luna | |
| 4,411,352 A | | 10/1983 | Kettle | |
| 4,662,502 A | | 5/1987 | Nakatani | |
| 4,746,000 A | | 5/1988 | Nakatani et al. | |
| 4,809,840 A | | 3/1989 | Nakatani | |
| 4,895,239 A | | 1/1990 | Johnson et al. | |
| 4,949,832 A | * | 8/1990 | Sansevero | 198/328 |
| 5,033,606 A | * | 7/1991 | Matoba et al. | 198/328 |
| 5,158,167 A | | 10/1992 | Pahl | |
| 5,165,513 A | | 11/1992 | Nakatani | |
| 5,544,729 A | | 8/1996 | Brunn | |

FOREIGN PATENT DOCUMENTS

| | | | | |
|---|---|---|---|---|
| CH | 345999 | * | 6/1960 | |
| DE | 100 55 982 A1 | | 6/2002 | |
| JP | 02086590 A | * | 3/1990 | B66B/21/08 |
| JP | 04140297 A | * | 5/1992 | B66B/21/00 |
| WO | wo 09106501 A1 | * | 5/1991 | B66B/21/00 |

* cited by examiner

*Primary Examiner*—Khoi H. Tran
*Assistant Examiner*—Mark A. Deuble
(74) *Attorney, Agent, or Firm*—Craig A. Fieschko, Esq.; DeWitt Ross & Stevens S.C.

(57) ABSTRACT

An escalator has steps shaped (1) to negotiate curves. The steps are suitably linked (4)(5)(6), guided (3)(10)(11), contained and powered so that the escalator can rise, fall, follow a horizontal path, be straight or curved in any predetermined sequence within the design parameters. The steps remain usable in both the flow and return paths. Shields are fitted to guard against entrapment of shoes or other apparel between the moving and stationary parts. For boarding or alighting safely, straight horizontal lengths may be included with appropriate means for passengers crossing from or to a stationary floor.

24 Claims, 7 Drawing Sheets

17
18
16
17
18

Figure 10
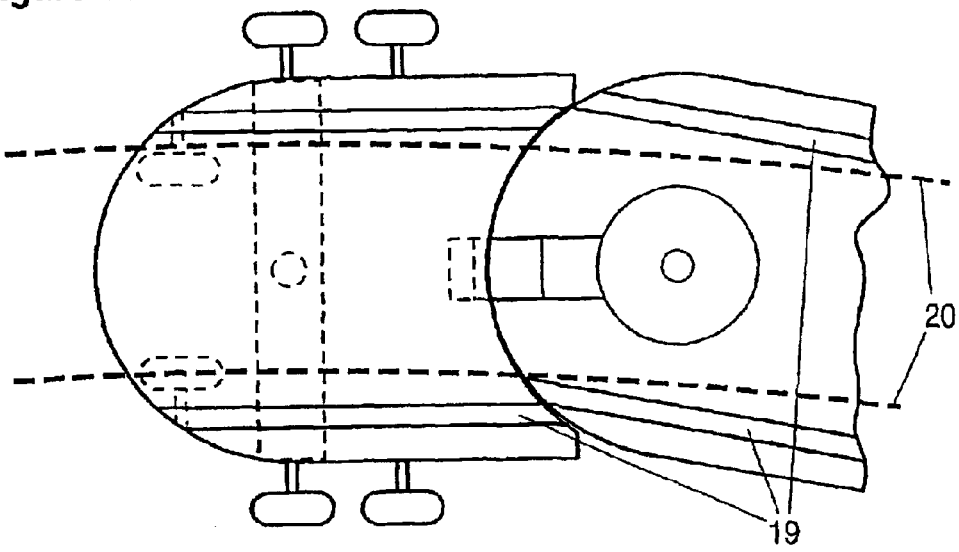
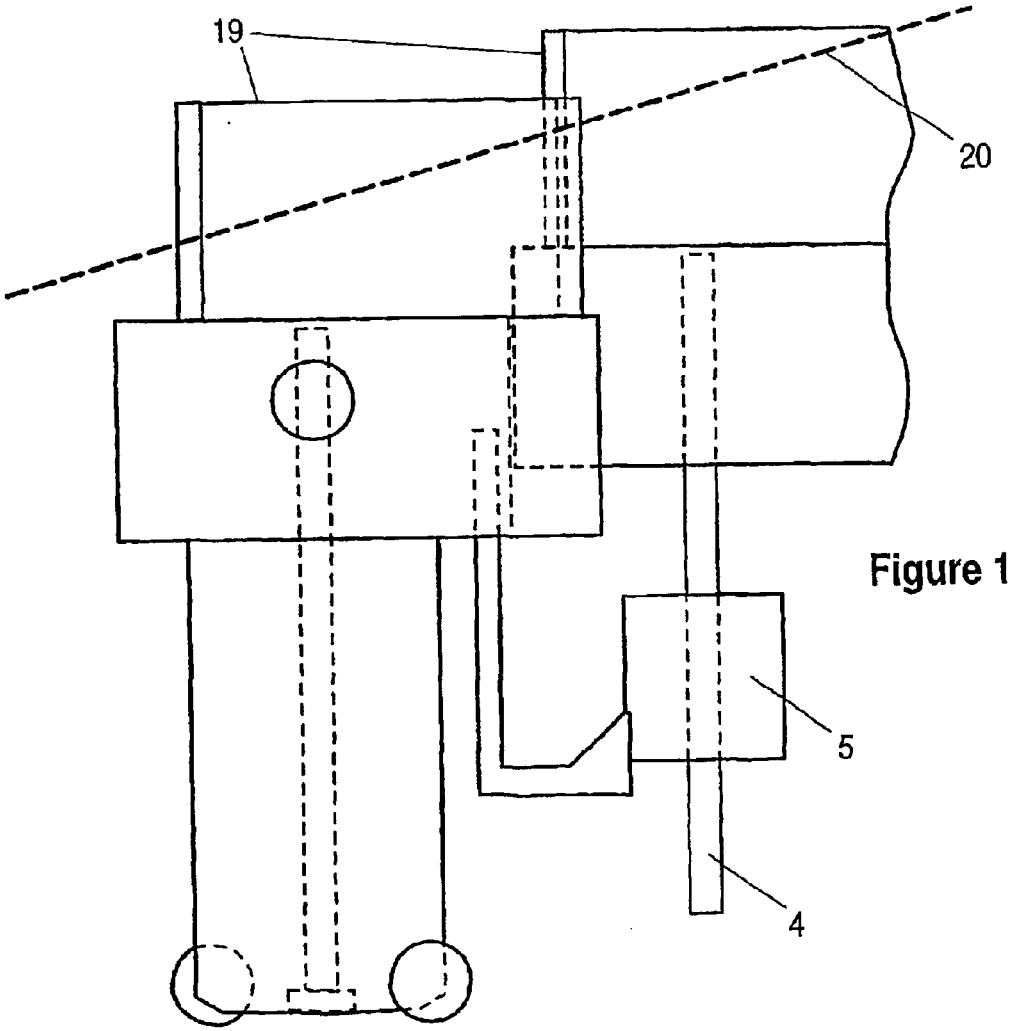
Figure 11

ESCALATOR FOR NEGOTIATING CURVES

FIELD OF THE INVENTION

The present invention relates to an escalator for negotiating curves.

BACKGROUND OF THE INVENTION

Escalators are well known machines for transporting pedestrians and their luggage from one level to another. However, the conventional design is suitable only for straight runs, viewed in plan, which severely limits their possible range of applications.

Moreover 50% of their steps at any one time are wastefully out of use because they are returning underneath the steps which are in use. This also means that a large part of the equipment is below the track so that maintenance may be difficult and expensive.

WO 91/06501 discloses a circular escalator which follows a closed loop having curved and straight sections. The treads of the escalator steps are tapered towards the inner radius of the curve to enable the steps to negotiate the curve. A complicated gearing mechanism causes parts of the inner ends of the steps to splay outwards in order to negotiate straight sections. However, this results in gaps between the steps, and so the escalator is not suitable for carrying passengers on straight sections. Moreover, the radius of the curved sections must be uniform for the length of the curved section, the radius being determined by the extent of the tapering of the step treads. The disclosed escalator could not therefore be used to negotiate a path which had a plurality of curved sections of different radius.

Other curved escalators are disclosed in various patents or patent applications, but these tend either to have tapered steps as described above (see for example U.S. Pat. No. 5,158,167), thereby leading to dangerous gaps on straight sections, or to employ steps which are shaped to move around constant radius curves, but which cannot be adapted for use on curves having different radii. For example, U.S. Pat. No. 5,544,729 employs a complex formula to calculate the shape of each step, but the resulting steps can only be used for use around one particular curve. A slightly simpler system is disclosed in U.S. Pat. No. 5,165,513, but the shape of the steps used therein would result in gaps between the treads if they were used on any path other than a circular one.

Further escalators with these short-comings are disclosed in U.S. Pat. No. 3,878,931, U.S. Pat. No. 4,809,840, U.S. Pat. No. 4,746,000, and U.S. Pat. No. 4,662,502 and U.S. Pat. No. 4,895,239 and U.S. Pat. No. 4,411,352.

SUMMARY OF THE INVENTION

According to a first aspect of the present invention, there is provided an escalator for negotiating curves, comprising a plurality of steps disposed sequentially in a curved path, each step having a tread with a leading and a trailing edge in the direction of movement of the escalator, and means for driving the steps along the path, wherein the treads are shaped such that the trailing edge of the tread of one step is curved to match a corresponding curve of the leading edge of the tread of the subsequent step so that the said steps fit together as they move around the curve of the escalator path.

The fit between adjacent steps in the present invention results in an escalator having negligible gaps between adjacent steps, no matter what curve the steps are following (within the design limits), without the need for a complex system to expand or contract the size of the steps to fill the gap as the extent of the curve changes.

Each step is preferably adapted to rotate about a vertical axis through the step, to assist in negotiating the curved path.

Although the curved path may have horizontal sections, the invention particularly relates to a path with at least one ascending or descending section. In a preferred embodiment, the curved path is a closed loop, such that the steps can be driven around the loop endlessly. If the path is a loop, then clearly each escalator step will return to the same level after one complete circuit. A reversing capability may be provided.

Each step preferably comprises a substantially vertical shaft and a bush for receiving the journal of the shaft on an adjacent step, the shaft and bush arrangement permitting relative vertical displacement of adjacent steps as the steps ascend or descend an incline, and also relative movement of the steps in the vertical plane as said incline changes. In this manner, each tread is able to remain substantially horizontal as the step is driven up or down an incline. The arrangement also permits rotational movement of a step around the shaft on the adjacent step, thereby permitting the step to follow the curve of the escalator path.

Adjacent steps may be coupled by means of a linear bearing mounted on a vertical post carried by one of the steps with the centroidal axis of the bearing being co-linear with the centre of the curve forming the convex arc of the tread of the adjacent step.

The shaft and bush arrangement may provide the only coupling between adjacent steps, or an additional coupling may be provided. Although the bush may have runs of circular bearings to engage with the shaft journal, it preferably has a plurality of runs of linear bearings, since the majority of the relative movement of the steps is in the vertical plane.

In a preferred embodiment, the leading edge of the tread follows the arc of a circle, the centre of which is co-linear with the longitudinal axis of the shaft, with said axis passing through the centre of curvature of the said arc.

The escalator preferably comprises a track which defines the path of the escalator, and each step preferably has at least one roller (such as a wheel) for supporting the step on the track and for rolling along the track as the step is driven along the escalator path.

In a particularly preferred embodiment, each step has a first and a second wheel, and a first and second track are provided for supporting said first and second wheels, wherein the relative vertical displacement of said first and second tracks is varied in order to define the desired incline of the escalator path whilst keeping the treads of the steps horizontal. Most preferably, said first and second wheels are disposed substantially on a horizontal plane on the step (that is, parallel to the plane of the tread), such that the first track is higher than the second track for a descending escalator path, lower than the second track for an ascending escalator path, and level with the second track for a level escalator path.

A plurality of first and second tracks may be provided. For example, two first and second tracks may be provided, one on each side of the centre line of each step. The first track is preferably closer to the centre of the step than the second track for added stability.

The first and second wheels are preferably disposed at the lower end of each step. A third wheel or wheels may be provided at the higher end of the step (near to the tread).

A great advantage of the present invention is that at all times the steps are disposed above the track(s) on which they are supported, which allows for easy maintenance. For example, individual steps may be de-coupled from adjacent steps and removed for maintenance or replacement. Accordingly, in a second aspect of the invention, there is provided a step for an escalator as defined above, comprising a tread with a curved leading edge and a correspondingly curved trailing edge. Preferably, the step has roller(s) as defined above for supporting the step on escalator track(s), and a shaft and bush as defined above.

A preferred embodiment of the invention comprises an escalator arrangement consisting of a succession of suitably shaped load-bearing units upon which people can stand and having couplings between adjacent units that allow relative motion not just by vertical displacement to form steps but also by swivelling so that the step units, while remaining nested, can move as a generalised type of escalator capable of traversing sequences of straight and curved paths which may include ascending, descending and horizontal stretches and in which the steps can remain usable during both the flow and return paths. A variety of established means can be employed to drive the escalator notwithstanding its ability to negotiate a sequence of straight and curved paths which may also rise and fall.

There may be a motor or motors mounted externally to the escalator and operating a drive (for example of the rack and pinion type) coupled to the escalator. Alternatively the motors may be carried on board the escalator. In the latter case the drive may be provided by electric motors carried by the support units themselves. The motors would be suitably coupled to the wheels engaging the track. Power to the motors could preferably be derived from electrical conduits set, in this case, within the containing channel by any one of the methods well known in the art. Ideally, motors need not be provided on every step unit but only on every $2^{nd}$, $3^{rd}$, $4^{th}$ etc. in such a manner that the power available matches the requirements of the length, gradients and general configuration of the escalator.

Alternatively hydraulic motors or linear motors may be used to drive the support units.

Whichever type of drive is used, arrangements are provided to halt the escalator safely in the event of a power failure or in response to an alarm signal. Well known systems such as those of the electromagnetic type are available for this purpose.

In a preferred embodiment, each step, and in particular the tread, is shaped at one end with the convex arc of a circle and at the other end (separated from the first end by a straight portion of any desired length) with the concave arc of a circle of the same radius so that, when assembled, the convex part of one tread fits into the concave part of the next whatever the relative angle (up to the design maximum) between their centre lines.

Each step may be provided with runners enabling their top surfaces to be maintained horizontally during movement whatever the straight, curved, ascending or descending path of the escalator.

The escalator may be contained within a supporting structure, which is preferably a suitably shaped channel manufactured preferably from metal or concrete.

Suitable guard pieces may be provided to prevent accidents to users. For example, the escalator may have a handrail either fixed to the supporting structure or to each step.

In a preferred embodiment, each step of the escalator additionally comprises upstanding guards on either side of the tread, each step's guards being sufficiently close to the corresponding guards on the adjacent steps and of sufficient thickness (preferably from 10 to 45 mm) for there to be a minimal gap between said guards at any point on said curved path.

In one embodiment, said guards move between a first upstanding position and a second lower position to enable the steps to pass under a horizontal platform with a minimal gap between the upper surface of the tread and the platform. For example, the guards may be mounted on an undercarriage which rolls on a track, the track height lowering as the step passes under said horizontal platform to move said guards from the first to the second position. Preferably, the top of the guard is substantially level with or below the upper surface of the tread in the second position.

Alternatively, the steps may be lowered to enable the steps and the upstanding guards to pass under a horizontal platform.

Additional guards may be provided on either side of the tread (interposed between the upstanding guards and an escalator user), the additional guards being mounted independently of the upstanding guards and remaining static as the steps move along the escalator path.

The steps may additionally or alternatively be fitted with wheels which rotate on vertical or inclined axes and run against the wall of the support channel in order to stabilise the escalator against sideways movement along all or part of its length.

The escalator preferably comprises a horizontal portion with stationary flooring overlaid to enable people to step on or off safely.

The escalator can be placed and fixed over an existing ordinary staircase.

BRIEF DESCRIPTION OF THE DRAWINGS

A specific embodiment of the invention will now be described by way of example with reference to the accompanying drawings in which:

FIG. 10 is plan view of an arrangement of shields fixed to each step to help guard against passenger entrapment;

FIG. 11 is an elevation of FIG. 10;

DETAILED DESCRIPTION OF PREFERRED VERSIONS OF THE INVENTION

Arrangement for Curving

Figure 1:
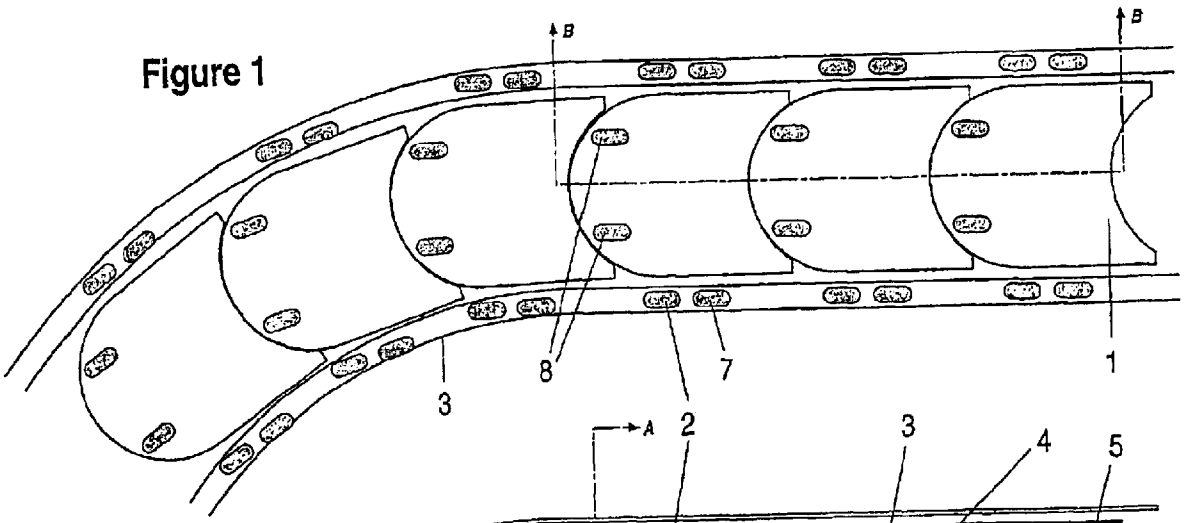
FIG. 1 shows a plan view of some linked units in a curved and straight path.

Referring to the drawings, FIG. 1 shows a plan view of a straight and curved portion of an example of the new type of escalator. The treads (1) are shaped at one end with the convex arc of a circle and at the other end with the concave arc of a circle of the same radius.

When assembled, the convex arcuate part of one tread fits into the concave part of the next whatever the relative angle (up to the design maximum) between their centre lines. This angle can vary from one pair of treads to the next.

Such an escalator for negotiating curves may comprise an open loop with a reversing capability or an endless loop with an optional reversing capability.

Connection Between the Units

Figure 2:
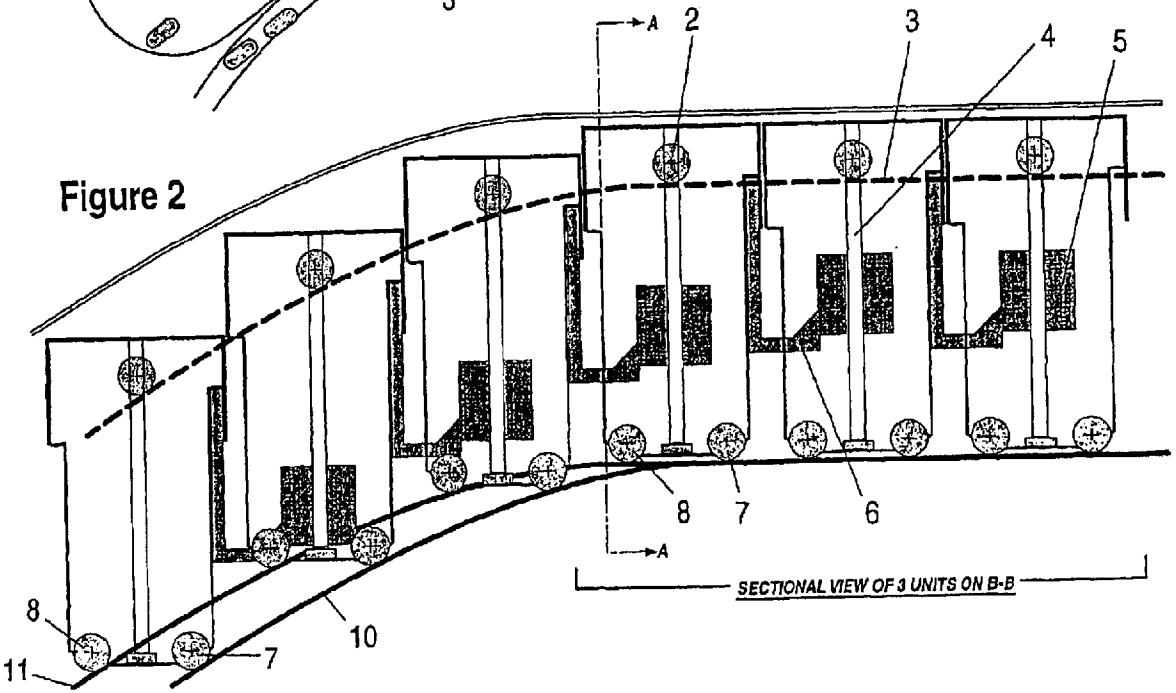
FIG. 2 shows a sectioned elevation projection of FIG. 1.

A type of connection between the units to provide the capability of relative up or down movement combined with the ability to swivel is shown in FIG. 2 which depicts an elevation corresponding to the plan of FIG. 1. Here a portion of the escalator is seen to be level on the right and descending on the left (or ascending if one is coming from the left). A vertical rod, the kingpost (4), is provided for each unit such that its centroidal axis is co-linear with the centre of the circle corresponding to the convex arc of the tread. The kingpost fits into a linear bearing (5) attached by a bracket (6) carried by the adjacent unit. The linear bearing, which can be one of a number of types, permits both the required relative up-and-down movement and the required rotational movement between adjacent units. Other linking and bearing arrangements are possible to achieve these relative movements between adjacent units.

For adjacent steps to be able to move above and below each other consequent on sequential ascending and descending paths of the escalator, a 3-step height relative movement is necessary between units. The mounting of the linear bearing allows this amount of vertical movement as can be seen from FIG. 2.

Arrangement for Vertical Movement while on a Curve

Figure 3:
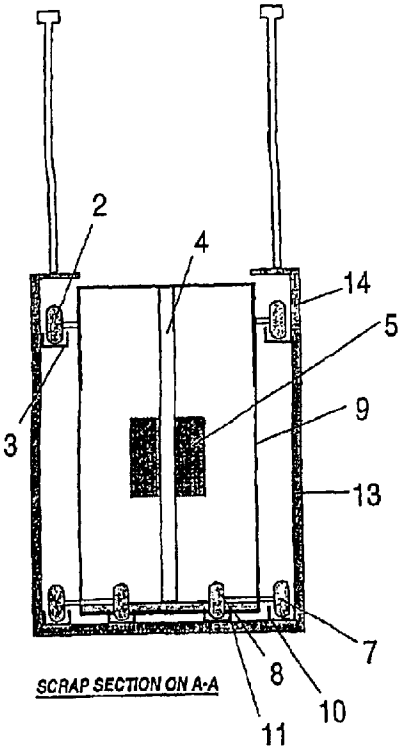
FIG. 3 shows a cross-section of a unit from FIG. 2.

In this embodiment to maintain the treads horizontally, each unit has beneath it two pairs of wheels, the outer wheels (7) and the inner wheels (8) as also depicted in the sectional view of FIG. 3. In this instance the wheels are mounted on the outside and inside respectively of the sideplates (9).

Figure 4:
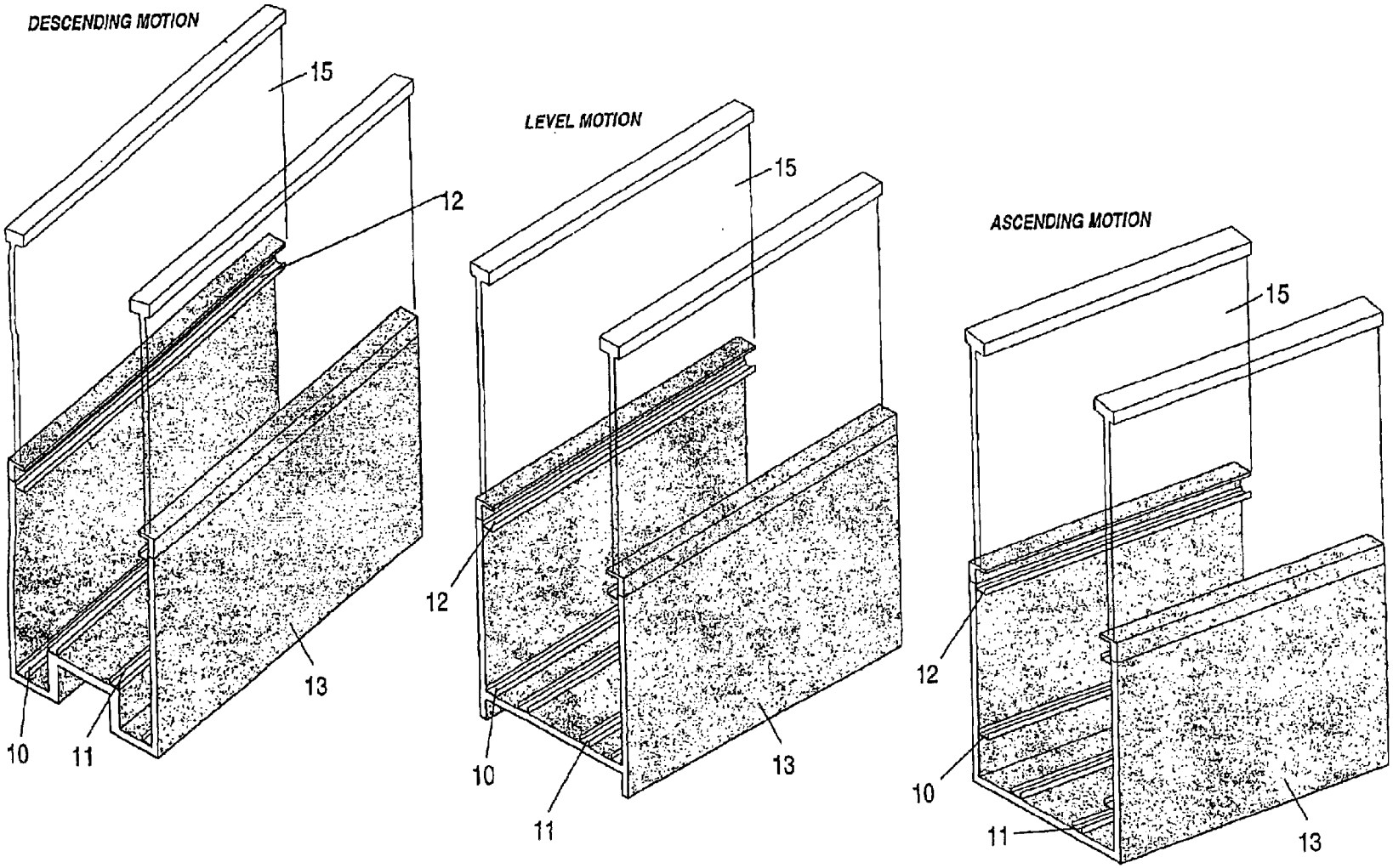
FIG. 4 shows an arrangement of tracks for descending, level and ascending paths of the units.

The outer and inner sets of wheels thus run on separate tracks or rails, as depicted in FIG. 4. The outside wheels run on track (10) while the inside wheels run on the separate track (11). By setting these tracks at appropriate different levels along the escalator, the treads (1) remain horizontal at all times.

By means of the arrangement for curving and the arrangement of track levels, as described, the units can form an escalator which rises, falls, follows a horizontal path, be straight or curved in any predetermined sequence within the design parameters. Each tread in this case may carry a pair of stabilising wheels (2) which run on an upper set of suitably aligned tracks or rails (3), see FIG. 1.

Other arrangements of wheels and tracks are possible which, together with the characteristics of the connection between the units, one of which is described above, enables the tops of the units to remain horizontal and closely coupled to one another under all design conditions. Ideally each wheel rotates on its own individual axle to accommodate the different curvatures of the tracks or rails.

Figure 5:
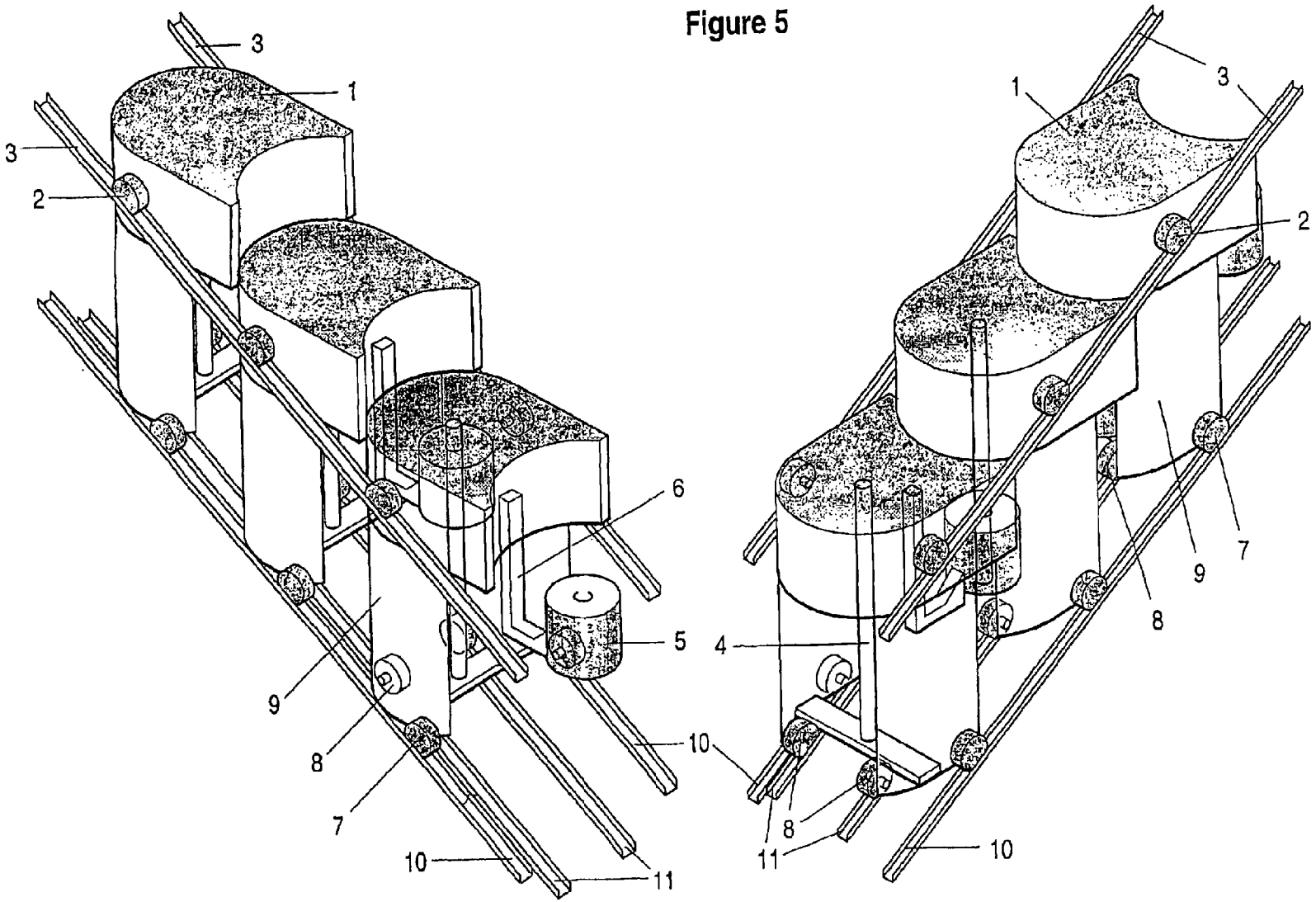
FIG. 5 shows perspective views of ascending and descending units.

FIG. 5 gives perspective views of the units ascending and descending. To assemble them the kingpost (4) fits into the linear race (5) on the next unit so that vertical sliding and horizontal rotary motion can take place.

Containment

Referring to FIGS. 3 and 4, the whole apparatus is contained within a supporting structure, in this case the channel (13) which may be formed of metal or concrete. The channel is equipped with suitable guard pieces (14) to prevent accidents to users. The whole of the working parts (not shown) may be situated above the two lower tracks making for ease of installation and maintenance. Handrails (15) are fitted to the channel (13) but may be fitted separately to each tread depending upon the application.

The units may also be fitted with wheels (not shown) which rotate on vertical or inclined axes and run against the wall of the support channel (13) in order to stabilise the escalator against sideways movement along all or part of its length.

Getting On and Off the Escalator

Pedestrians can get on and off the escalator in similar manner to existing escalators. Horizontal runs of the moving steps are provided which pass under a section of static flooring with a "toothcomb" from the flooring engaging with matching grooves in each stair enabling pedestrians to leave the escalator. The escalator would then emerge for the opposite process to take place so that people could board the escalator safely. An example is shown in FIG. 6.

Figures 6, 7, 8, 9:
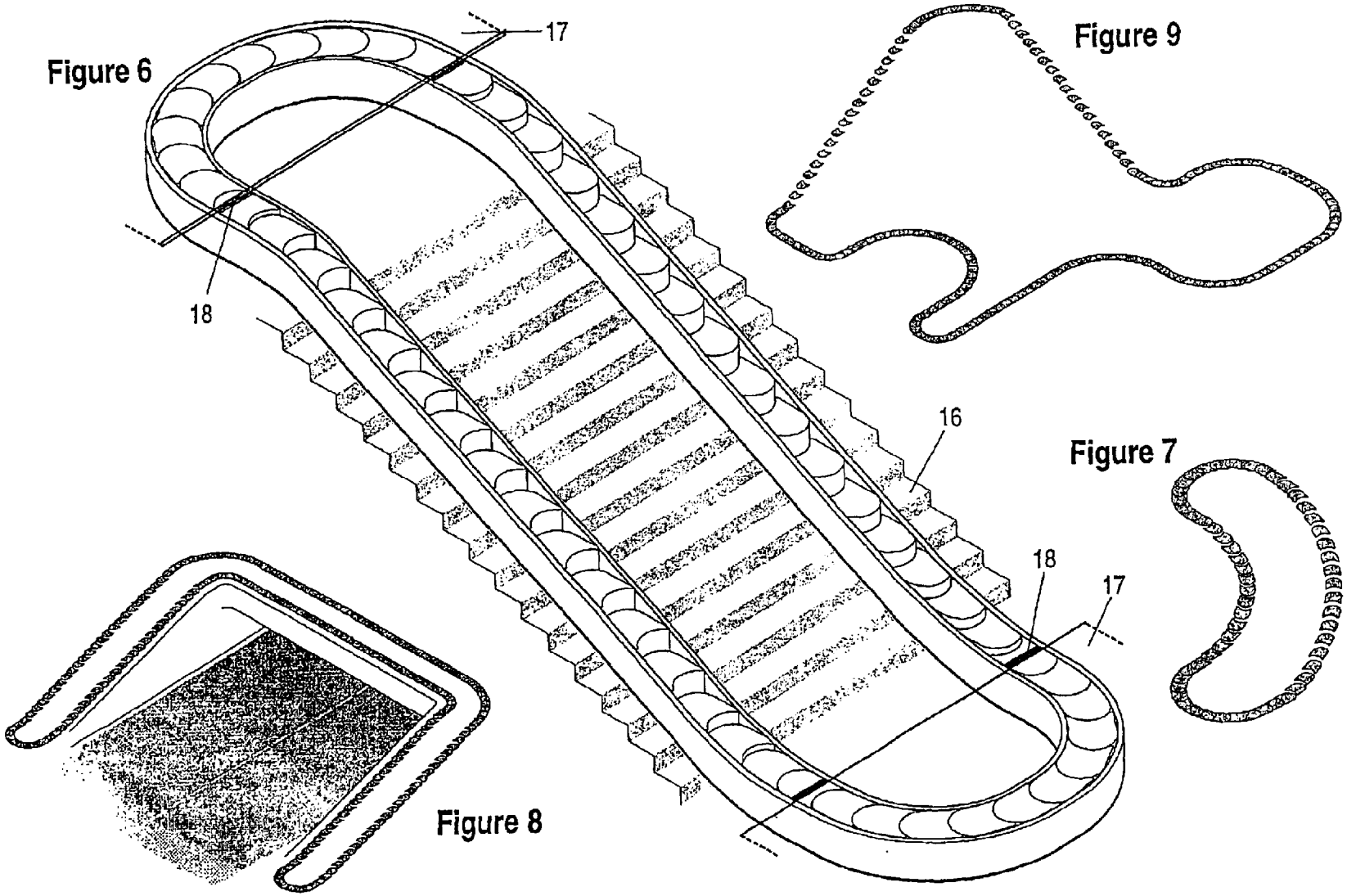
FIG. 6 is a schematic showing the invention fitted over an existing staircase.
FIG. 7 is a schematic showing a freestanding or supported escalator for negotiating curves which sweeps from one floor to another and can follow similar or different ascending and descending paths.
FIG. 8 is a schematic showing the invention acting as a mechanised crossing for pedestrians to pass above or below roads, railways or other obstacles.
FIG. 9 is a schematic showing the invention being used to convey pedestrians on a multi-level tour of an exhibition, theme park etc.

Alternative embodiments of the invention include the following:

FIG. 6 shows an alternative embodiment of the invention fitted over an existing staircase (16) with the static flooring at (17) and the toothcombs at (18).

FIG. 7 shows an alternative embodiment of the invention—a freestanding or supported escalator for negotiating curves which sweeps from one floor to another and can follow similar or different ascending and descending paths.

FIG. 8 shows an alternative embodiment of the invention that can act as a mechanised crossing for pedestrians to pass above or below roads, railways or other obstacles.

FIG. 9 shows an alternative embodiment of the invention in which an escalator for negotiating curves can take pedestrians on a multi-level tour of an exhibition, theme park etc.

Shielding Between Stationary and Moving Parts

In all escalators there is the danger of entrapment of passengers clothes, feet, bags etc. between the moving stairs and the stationary sides. On curved escalators this problem is made more difficult because of the variation of the gaps along the run. This variation can be seen for example in FIG. 1.

A solution is shown in FIGS. 10 (plan) and 11 (elevation) where each tread carries a pair of preferably vertical shields (19) mounted and shaped in such a manner that when the centre lines of adjacent treads are inclined to one another, as in FIG. 10, the shields maintain a virtually continuous barrier between passengers and the stationary wall of the escalator. Additional protection is provided by the fixed shields (20) indicated by the broken lines in FIGS. 10 and 11 and shown in the front view of FIG. 12 where they are integral with the handrail structure (15).

To maximise protection these fixed shields (20) are shaped to fit the local curve of the escalator and also its angle or drop at each point along the run.

Figure 13:
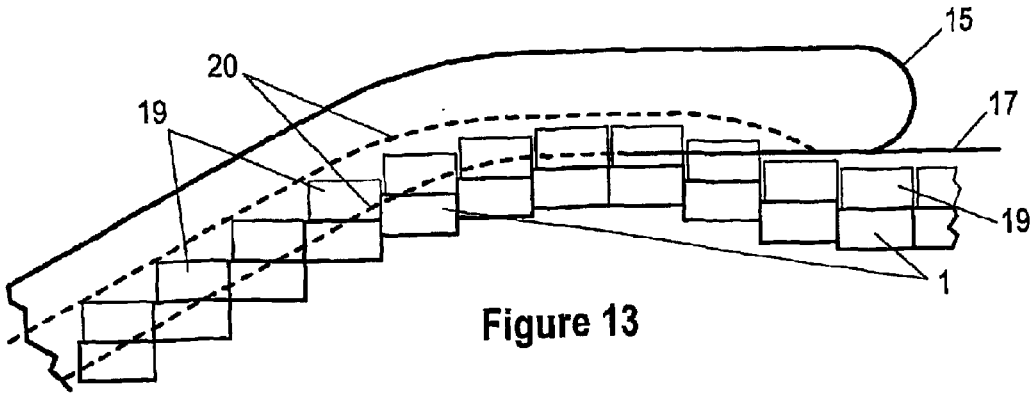
FIG. 13 is a sketch illustrating the movement of the shields of FIG. 10 at the top of an escalator.

The situation at the horizontal locations where people exit the escalator is sketched in FIG. 13. As in established practice, combs engage the track to allow pedestrian access to the stationary floor (17). The moving shields (19) remain behind the stationary shields (20) but the escalator then dips beneath the floor by about one step depth so that the shields (19) travel under the floor allowing the pedestrians to leave the escalator area. The opposite movement of the steps and moving shields then occurs so that people can board the escalator.

Figure 14:
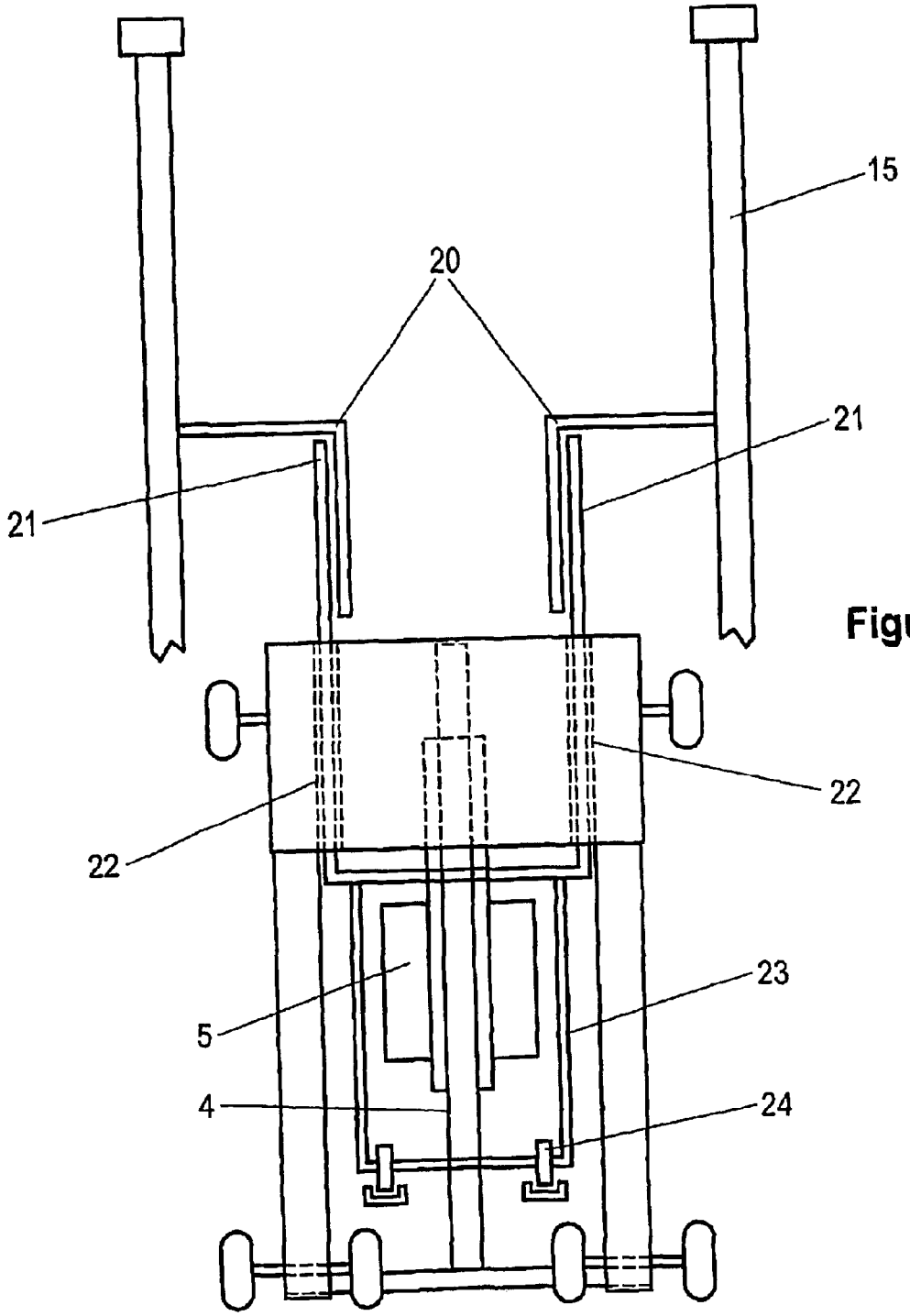
FIG. 14 shows an alternative method of shielding for each step.

An alternative arrangement which avoids this complication at the entry and exit points is depicted in FIG. 14. Here the moving shields (21) pass through slots (22) in the corresponding treads and are carried by underframes (23) mounted on a separate set of wheels and tracks (24). At the horizontal entry and exit points the tracks carrying the underframe are set appropriately lower so that the tops of the shields (21) are level with the treads. Thus they can pass under the stationary comb at the entry and exit points.

Figure 12:
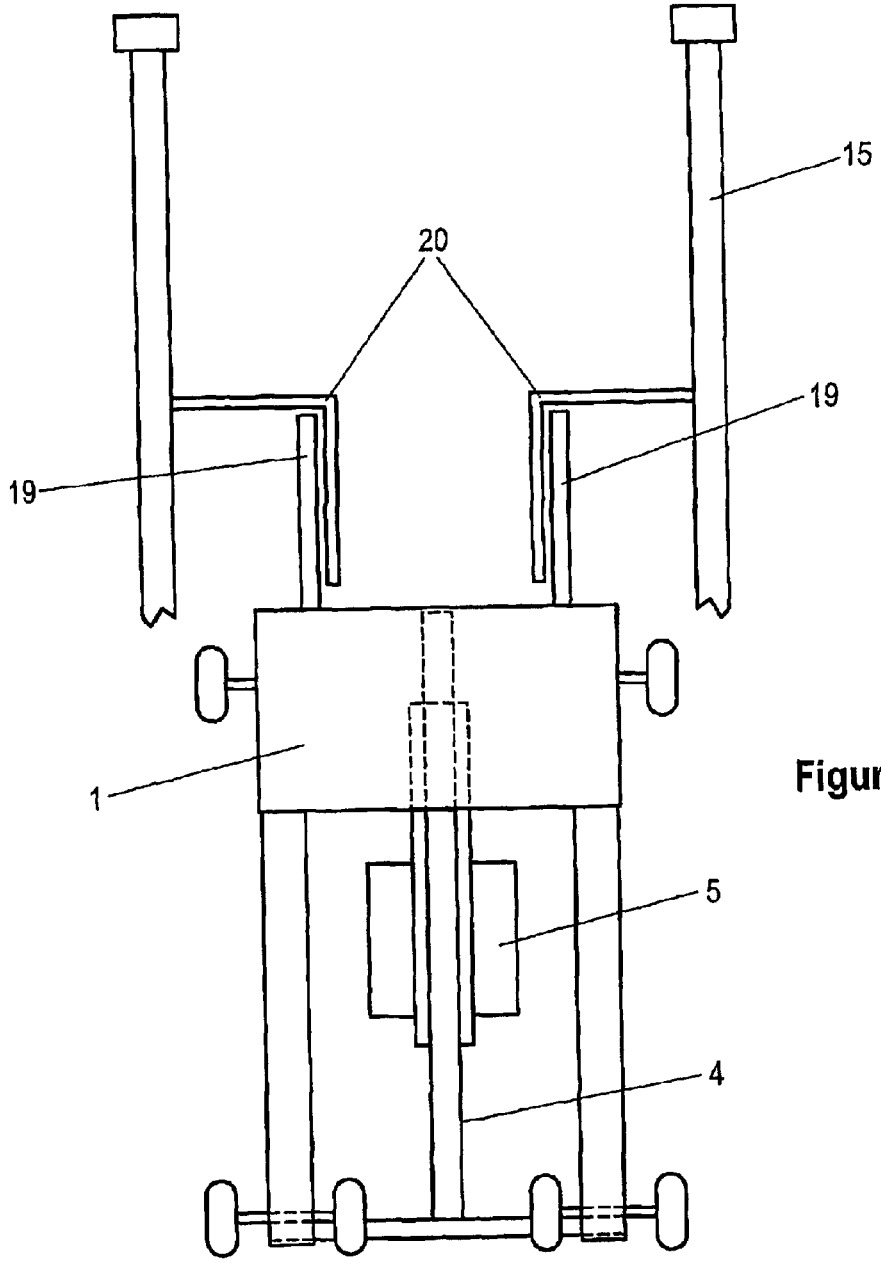
FIG. 12 is a front view of FIG. 10.

In both the arrangements of FIGS. 12 and 14, in accordance with contemporary practice, brushes may also be fitted along the lower edge of the fixed shields (20) to provide a warning and psychological barrier to passengers.

What is claimed is:

1. An escalator for negotiating curves comprising a plurality of steps disposed sequentially in a curved path along which the steps are driven, each step having a head with a leading and a trailing edge in the direction of movement of the escalator, wherein the treads are shaped such that the trailing edge of the head of one step is curved to match a corresponding curve of the leading edge of the tread of the subsequent step, so that the steps fit together as they move about the curved path, and each step:

a. is adapted to rotate about a vertical axis through the step, wherein the vertical axes between adjacent steps are restrained relative to each other to have a fixed horizontal distance; and b. each step is adapted to vertically translate with respect to the vertical axes of its adjacent steps.

2. The escalator of claim 1 wherein the curved path is a closed loop, such that the steps can be driven around the loop endlessly.

3. The escalator of claim 1 wherein each step includes:

a. a substantially vertical shaft having a journal, and b. a bush for receiving the journal of the shaft on an adjacent step, the shaft and bush permitting relative vertical displacement of adjacent steps as the steps ascend or descend an incline.

4. The escalator of claim 3 wherein each bush has a plurality of runs of linear bearings to engage with the shaft journal.

5. The escalator of claim 3 wherein the leading edge of each tread follows the arc of a circle, the center of which is collinear with the longitudinal axis of the shaft, with the axis passing through the center of curvature of the arc.

6. The escalator of claim 1 wherein each step include:

a. a first and a second wheel, and b. a first and second track supporting the first and second wheels, wherein the relative vertical displacement of the first and second tracks defines the desired incline of the escalator path while keeping the treads of the steps horizontal.

7. The escalator of claim 6 wherein:

a. the first and second wheels are disposed substantially on a horizontal plane, and b. the first track is:

(1) higher than the second track for a descending escalator path, (2) lower than the second track for an ascending escalator path, and (3) level with the second trick for a level escalator path.

8. The escalator of claim 1 wherein each step additionally has upstanding guards on either side of the tread, each step's guards being sufficiently close to the corresponding guards on the adjacent steps and of sufficient thickness for there to be a minimal gap between the guards at any point on the curved path.

9. The escalator of claim 8 wherein the thickness of the guards is from 10 to 45 mm.

10. The escalator of claim 8 wherein the guards move between a first upstanding position and a second lower position to enable the steps to pass under a horizontal platform with a minimal gap between the upper surface of the tread and the platform.

11. The escalator of claim 10 wherein in the second position the top of the guard is substantially level with or below the upper surface of the tread.

12. The escalator of claim 10 wherein the guards are mounted on an undercarriage which rolls on a track, the track height lowering as the step passes under the horizontal platform to move the guards from the first to the second position.

13. The escalator of claim 8 wherein the steps are lowered to enable the steps and the upstanding guards to pass under a horizontal platform.

14. The escalator of claim 8 comprising additional guards on either side of static as the steps move along the escalator path.

15. The escalator of claim 14 wherein the additional guards are interposed between the upstanding guards and an escalator user.

16. A step for use in the escalator of claim 1 comprising a tread with a curved leading edge and a correspondingly curved trailing edge.

17. The escalator of claim 1 wherein each step:

a. has a vertical axis defined by a vertical shaft;

b. an adjacent step with a bush mounted thereon, the bush riding on the vertical shaft to vertically translate thereon.

18. The escalator of claim 17 wherein the bush is anchored in fixed horizontal relationship to the adjacent step to which it is mounted.

19. An escalator for negotiating curves comprising several steps arrayed in sequence about a curved path along which the steps travel, each step having opposing leading and trailing edges facing their direction of travel, wherein:

a. the trailing edge of one step is complementarily curved with respect to the leading edge of the adjacent step, whereby the adjacent steps fit together as they travel about the curved path, b. each step includes:

(1) a vertical shaft about which the step rotates; and (2) a bush horizontally spaced by a fixed distance from the vertical shaft, wherein the bush is fit about the shaft of an adjacent step to both rotate and vertically translate thereon, whereby adjacent steps are allowed to rotate and vertically translate with respect to each other as they travel about their curved path.

20. The escalator of claim 19 wherein the curved path is a closed loop, such that the steps can be driven around the loop endlessly.

21. The escalator of claim 19 wherein each bush has a plurality of runs of linear bearings to engage with the shaft journal.

22. The escalator of claim 19 wherein each step includes:

a. a first and a second wheel, and b. a first and second track supporting the first and second wheels, wherein the relative vertical displacement of the first and second tracks defines the desired incline of the escalator path while keeping the treads of the steps horizontal.

23. The escalator of claim 22 wherein:

a. the first and second wheels are disposed substantially on a horizontal plane, and b. the first track is:

(1) higher than the second track for a descending escalator path, (2) lower than the second track for an ascending escalator path, and (3) level with the second track for a level escalator path.

24. The escalator of claim 19 wherein each step additionally has upstanding guards on either side of the tread, each step's guards being sufficiently close to the corresponding guards on the adjacent steps and of sufficient thickness for there to be a minimal gap between the guards at any point on the curved path.

* * * * *